US006261119B1

(12) United States Patent
Green

(10) Patent No.: US 6,261,119 B1
(45) Date of Patent: Jul. 17, 2001

(54) LED LIGHT STRIP INSULATION-PIERCING CONNECTOR

(75) Inventor: Richard Jonathan Green, Mississauga (CA)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/489,429

(22) Filed: Jan. 21, 2000

(30) Foreign Application Priority Data

Jan. 22, 1999 (CA) ..... 2 259 885

(51) Int. Cl.[7] ..... H01R 4/24; H01R 4/26; H01R 11/20

(52) U.S. Cl. ..... 439/425; 439/411

(58) Field of Search ..... 439/411, 412, 439/425

(56) References Cited

U.S. PATENT DOCUMENTS

| | | | | |
|---|---|---|---|---|
| 2,419,652 | * | 4/1947 | McLarn | 439/411 |
| 5,848,837 | | 12/1998 | Gustafson | 362/235 |
| 5,934,930 | * | 8/1999 | Camps et al. | 439/425 |

FOREIGN PATENT DOCUMENTS 11-345635 * 12/1999 (JP)

* cited by examiner .

*Primary Examiner*—Neil Abrams
*Assistant Examiner*—Michael C. Zarroli
(74) *Attorney, Agent, or Firm*—Perman & Green, LLP

(57) ABSTRACT

An insulation-piercing connector interconnects an insulated conductor and a ribbon conductor embedded in an electrically insulating body. It comprises an insulation-piercing contact formed with a contact body and a tapered contact portion, and a housing device. A hole is made through both the electrically insulating body and ribbon conductor, this hole having a larger-diameter hole section and a smaller-diameter hole section separated by an annular abutment surface formed at least in part by one face of the ribbon conductor. The contact body comprises a larger-diameter body section inserted in the larger-diameter hole section, a smaller-diameter body section inserted in the smaller-diameter hole section, and an annular shoulder surface applied to the annular abutment surface to make contact with the ribbon conductor. The tapered contact portion has a threaded shank screwed in an axial threaded hole of the free end of the smaller-diameter body section to secure the tapered contact portion to the contact body. The tapered contact portion pierces the insulation of the insulated conductor to make contact with this conductor, and the housing device holds the tapered contact portion in contact with the insulated conductor to thereby establish an electrical connection between the insulated conductor and the ribbon conductor through the insulation-piercing contact.

12 Claims, 2 Drawing Sheets

LED LIGHT STRIP INSULATION-PIERCING CONNECTOR

BACKGROUND OF THE INVENTION

1. Field of the Invention

The present invention relates to an insulation-piercing contact and a corresponding connector capable of connecting, in particular but not exclusively, a pair of electric supply cables to the two longitudinal copper ribbons of a LED (Light Emitting Diode) light strip, respectively.

2. Brief Description of the Prior Art

LED light strips comprise a series of light emitting diodes distributed along the LED light strip. The light emitting diodes are supplied with electric current through a pair of spaced apart, longitudinal and electrically conductive copper ribbons. Both the right emitting diodes and the copper ribbons are embedded in an extrusion of at least partially transparent insulating plastic material.

LED light strips are currently used for many purposes, in particular in security lighting in aircrafts, buses, boats, buildings, etc.

To supply the light emitting diodes with electric current, electric supply cables have to be connected to the copper ribbons. Since the copper ribbons are usually exposed at each end of a LED light strip, a prior art connector has been proposed to connect electric supply cables to the exposed ends of the copper ribbons.

This prior art connector comprises a plastic housing containing a pair of spring-loaded pins. The spring-loaded pins are compression connected to respective electric supply cables and are applied to the exposed ends of the copper ribbons. In this manner, the supply cables are connected to the copper ribbons through the spring-loaded pins. The plastic housing is mounted to the end of the LED light strip with the spring-loaded pins applied to the exposed ends of the copper ribbons. For that purpose, a U-shaped metal bracket embraces the plastic housing and is secured to the at least partially transparent insulating material through a screw.

A drawback of the prior art connector is that connection of the supply cables to the copper ribbons is permitted only at the ends of the LED light strip where the ends of the copper ribbons are exposed. Another drawback of this prior art connector is its low reliability.

OBJECT OF THE INVENTION

An object of the present invention is therefore to provide an insulation-piercing connector capable of eliminating the above discussed drawbacks of the prior art.

SUMMARY OF THE INVENTION

More specifically, in accordance with the present invention as broadly claimed, there is provided an insulation-piercing contact for connecting an insulated conductor with a ribbon conductor embedded in an electrically insulating body, and for insertion in a hole made through both the electrically insulating body and ribbon conductor and having a larger-diameter hole section and a smaller-diameter hole section separated by an annular abutment surface formed at least in part by one face of the ribbon conductor. This insulation-piercing contact comprises (a) a contact body comprising a larger-diameter body section for insertion in the larger-diameter hole section, a smaller-diameter body section for insertion in the smaller-diameter hole section, and an annular shoulder surface for application to the annular abutment surface to make contact with the ribbon conductor, wherein the smaller-diameter body section has a free end, (b) a tapered contact portion for piercing the insulation of the insulated conductor to make contact with this conductor, and (c) means for securing the tapered contact portion to the free end of the smaller-diameter body section.

In accordance with a preferred embodiment of the insulation-piercing contact, the contact body comprises a geometrical axis, the tapered contact portion comprises a point for piercing the insulation of the insulated conductor to make contact with that conductor, and the securing means comprises:

- a threaded hole made in the free end of the smaller-diameter body section, this threaded hole being centered on the geometrical axis of the contact body; and
- a threaded shank of the tapered contact portion, the threaded shank being disposed 180° apart from the point and being screwed in the threaded hole for securing the tapered contact portion to the free end of the smaller-diameter body section.

The present invention also relates to an insulation-piercing connector for connecting an insulated conductor with a ribbon conductor embedded in an electrically insulating body, comprising an insulation-piercing contact for insertion in a hole made through both the electrically insulating body and ribbon conductor and having a larger-diameter hole section and a smaller-diameter hole section separated by an annular abutment surface formed at least in part by one face of the ribbon conductor. This insulation-piercing contact comprises:

- a contact body comprising a larger-diameter body section for insertion in the larger-diameter hole section and a smaller-diameter body section for insertion in the smaller-diameter hole section, and an annular shoulder surface for application to the annular abutment surface to make contact with the ribbon conductor, the smaller-diameter body section having a free end;
- a tapered contact portion for piercing the insulation of the insulated conductor to make contact with this conductor; and
- means for securing the tapered contact portion to the free end of the smaller-diameter body section.

Finally, the insulation-piercing connector includes a housing device for holding the tapered contact portion in contact with the insulated conductor to thereby establish an electrical connection between the insulated conductor and the ribbon conductor through the insulation-piercing contact.

Further in accordance with the present invention, there is provided an insulation-piercing connector for interconnecting (a) first and second insulated cables and (b) a LED light strip comprising an elongated body of at least partially transparent insulating material, a series of light emitting diodes distributed along the elongated body, first and second spaced apart longitudinal ribbon conductors embedded in the at least partially transparent insulating material for electrically supplying the light emitting diodes, and first and second holes made through both the elongated body and the first and second ribbon conductors, respectively, and having first and second larger-diameter hole sections and first and second smaller-diameter hole sections separated by first and second annular abutment surfaces formed at least in part by one face of the first and second ribbon conductors, respectively. The insulation-piercing connector comprises first and second insulation-piercing contacts respectively including:

first and second contact bodies comprising first and second larger-diameter body sections for insertion in the first and second larger-diameter hole sections, respectively, and first and second smaller-diameter body sections for insertion in the first and second smaller-diameter hole sections, respectively, and first and second annular shoulder surfaces for application to the first and second annular abutment surfaces to make contact with the first and second ribbon conductors, respectively, the first and second smaller-diameter body sections having respective first and second free ends;

first and second tapered contact portions for piercing the insulation of the first and second insulated cables, respectively, and making contact with the first and second cables; and first and second means for securing the first and second tapered contact portions to the first and second free ends of the first and second smaller-diameter body sections, respectively.

The insulation-piercing connector further includes a housing device (a) for holding the first tapered contact portion in contact with the first cable to thereby establish a first electrical connection between the first cable and the first ribbon conductor through the first insulation-piercing contact, and (b) for holding the second tapered contact portion in contact with the second cable to thereby establish a second electrical connection between the second cable and the second ribbon conductor through the second insulation-piercing contact.

The invention is further concerned with a method for connecting an insulated conductor with a ribbon conductor embedded in an electrically insulating body, comprising the steps of:

making a hole through both the electrically insulating body and ribbon conductor, this hole having a larger-diameter hole section and a smaller-diameter hole section separated by an annular abutment surface formed at least in part by one face of the ribbon conductor; inserting in that hole a contact body comprising a larger-diameter body section and a smaller-diameter body section separated by an annular shoulder surface, the inserting step comprising disposing the larger-diameter body section in the larger-diameter hole section, disposing the smaller-diameter body section in the smaller-diameter hole section, and applying the annular shoulder surface to the annular abutment surface to make contact with the ribbon conductor, that smaller-diameter body section having a free end;

securing a tapered contact portion to the free end of the smaller diameter body section;

piercing the insulation of the insulated conductor by means of the tapered contact portion to make contact with the insulated conductor; and holding the tapered contact portion in contact with the insulated conductor to thereby establish an electrical connection between the insulated conductor and the ribbon conductor through the contact body and tapered contact portion.

Finally, according to the present invention, there is provided a method for interconnecting (a) first and second insulated cables and (b) a LED light strip comprising an elongated body of at least partially transparent insulating material, a series of light emitting diodes distributed along the elongated body, first and second spaced apart longitudinal ribbon conductors embedded in the at least partially transparent insulating material for electrically supplying the light emitting diodes, comprising the steps of:

making a first hole through both the elongated body and first ribbon conductor, this first hole having a first larger-diameter hole section and a first smaller-diameter hole section separated by a first annular abutment surface formed at least in part by one face of the first ribbon conductor;

making a second hole through both the elongated body and second ribbon conductor, this second hole having a second larger-diameter hole section and a second smaller-diameter hole section separated by a second annular abutment surface formed at least in part by one face of the second ribbon conductor;

inserting in the first hole a first contact body comprising a first larger-diameter body section and a first smaller-diameter body section separated by a first annular shoulder surface, the first contact body inserting step comprising disposing the first larger-diameter body section in the first larger-diameter hole section, disposing the first smaller-diameter body section in the first smaller-diameter hole section, and applying the first annular shoulder surface to the first annular abutment surface to make contact with the first ribbon conductor, the first smaller-diameter body section having a first free end;

securing a first tapered contact portion to the first free end of the first smaller-diameter body section;

inserting in the second hole a second contact body comprising a second larger-diameter body section and a second smaller-diameter body section separated by a second annular shoulder surface, the second contact body inserting step comprising disposing the second larger-diameter body section in the second larger-diameter hole section, disposing the second smaller-diameter body section in the second smaller-diameter hole section, and applying the second annular shoulder surface to the second annular abutment surface to make contact with the second ribbon conductor, the second smaller-diameter body section having a second free end;

securing a second tapered contact portion to the second free end of the second smaller-diameter body section;

piercing the insulation of the first and second insulated cables by means of the first and second tapered contact portions, respectively, to make contact with the first and second cables, respectively; and holding the first tapered contact portion in contact with the first cable to thereby establish a first electrical connection between the first cable and the first ribbon conductor through the first contact body and first tapered contact portion, and holding the second tapered contact portion in contact with the second cable to thereby establish a second electrical connection between the second cable and the second ribbon conductor through the second contact body and the second tapered contact portion.

Preferably, the method further comprises the step of sealing the first and second larger-diameter hole sections after the first and second contact bodies have been inserted in the first and second holes, respectively, and the first and second tapered contact portions have been secured to the first and second free ends, respectively.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
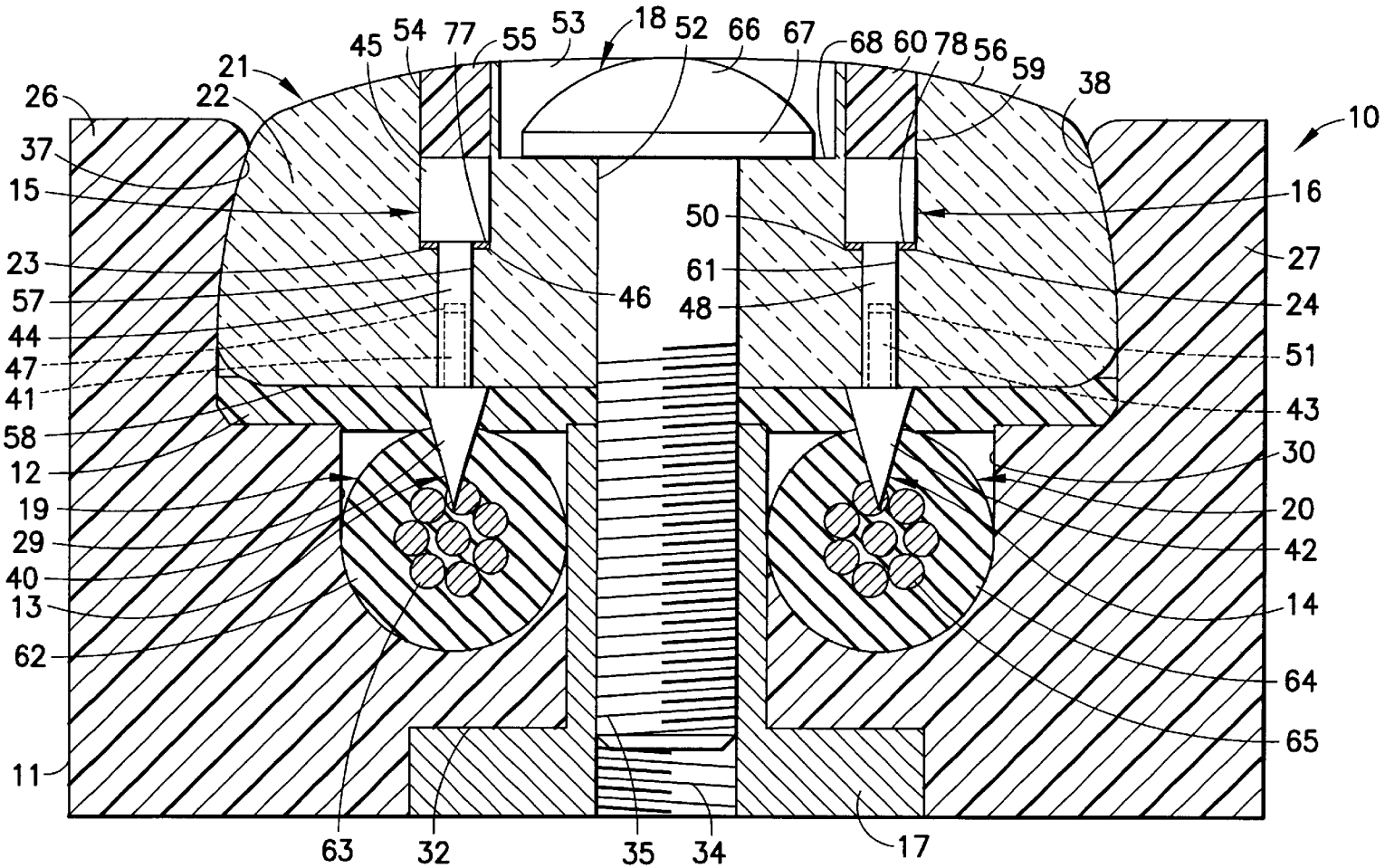
FIG. 1 is a cross sectional view of an insulation-piercing connector according to the present invention, interconnecting a pair of insulated cables to a LED light strip.
Figure 2:
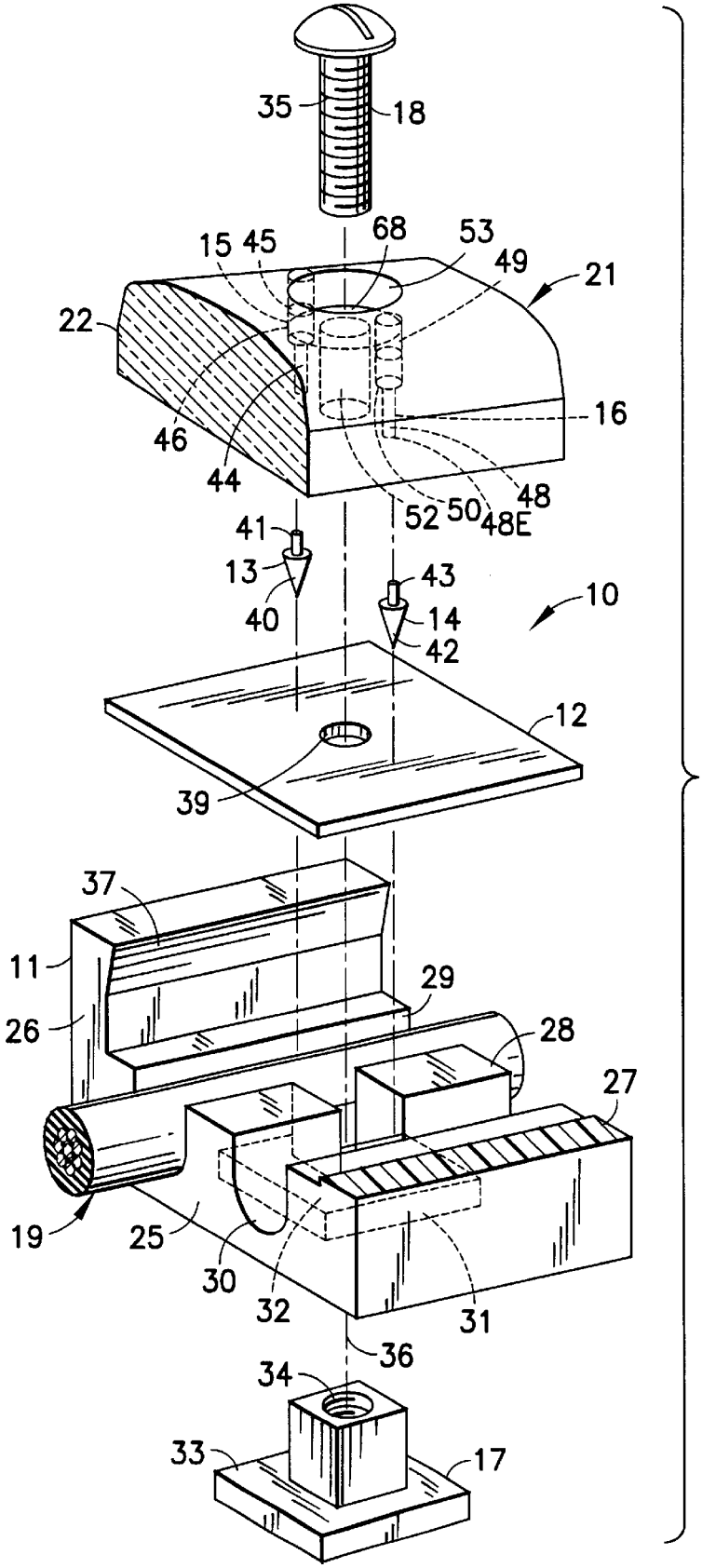
FIG. 2 is an exploded view of the insulation-piercing connector of FIG. 1, for connecting a pair of insulated cables to a LED light strip.

In the appended drawings, the insulation-piercing connector is generally identified by the reference 10. As illustrated in FIGS. 1 and 2, the insulation-piercing connector 10 comprises a housing channel 11, a silicone rubber plate member 12, two electrically conductive metallic tapered contact portions 13 and 14, two electrically conductive metallic contact bodies 15 and 16, a metallic nut insert 17, and a truss head machine screw 18.

FIGS. 1 and 2 further illustrate two insulated cables, for example two insulated stranded cables 19 and 20, and a LED light strip 21.

As can be seen in FIGS. 1 and 2, a LED light strip such as 21 comprises an elongated body, for example an extrusion 22 of insulating material, in particular but not exclusively plastic material. Embedded in the insulating material of the extrusion 22 are two spaced apart, longitudinal, parallel and coplanar metallic ribbon conductors 23 and 24 (See FIG. 1). Also embedded in the insulating material of the extrusion 22 are LEDs (Light Emitting Diodes (not shown)) having their anodes and cathodes respectively connected to the ribbon conductors 23 and 24 whereby the LEDs can be supplied through the ribbon conductors 23 and 24. Usually, the LEDs are evenly distributed along the LED light strip 21. Obviously, the insulating material of the extrusion 22 is at least partially transparent to enable transmission of the light produced by the LEDs.

Referring to FIGS. 1 and 2 of the appended drawings, the housing channel 11 comprises a bottom wall 25 and two lateral walls 26 and 27. The housing channel 11 defines a channel cavity defining a generally planar bottom face 28 constituted by the inner face of the bottom wall 25. A pair of longitudinal and parallel grooves 29 and 30 are made in the bottom face 28 to receive respective sections of the two insulated stranded cables 19 and 20, respectively. As shown, the bottom of the grooves 29 and 30 has a semicircular cross section to adapt to the cylindrical shape of the insulated cables 19 and 20. Also, the depth of the grooves 29 and 30 corresponds to the diameter of the insulated stranded cables 19 and 20. In this manner, the insulated stranded cables 19 and 20 snugly fit in the grooves 29 and 30, respectively.

The bottom wall 25 of the housing channel 11 further comprises a central insert-receiving aperture 31. Aperture 31 has a generally square cross section which is wider on the outer side of the bottom wall 25 to define a square, annular abutment surface 32 (FIGS. 1 and 2).

The insert 17 is preferably mounted in the aperture 31 to form part of the housing channel 11. More specifically, the insert 17 is configured to fit in the aperture 31 and is inserted in this aperture 31 from the outer side of the bottom wall 25. In particular, the insert 17 includes a square, annular shoulder surface 33 structured to rest on the abutment surface 32 of the aperture 31. Finally. the insert 17 is formed with a central threaded hole 34 to receive the threaded shank 35 of the screw 18. When the insert 17 is mounted in the aperture 31, the axis 36 of the hole 34 is perpendicular to the bottom wall 25, i.e. in a position suitable for receiving the shank 36 of the screw 18. Also, the shoulder surface 33 abuts against the abutment surface 32 to resist to the traction force exerted on the insert 17 by tightening of the screw 18.

Of course, it is within the scope of the present invention to provide complementary aperture 31 and insert 17 of various shapes and dimensions. The shapes and dimensions of the complementary aperture 31 and insert 17 as illustrated in the appended drawings are given for the purpose of exemplification only.

The distal portion of each lateral wall 26, 27 linearly thickens inwardly to form a wedge-like protuberance 37, 38 (FIGS. 1 and 2). The function of these wedge-like protuberances 37 and 38 is to clip the LED light strip 21 between the two lateral walls 26 and 27.

The silicone rubber plate member 12 (FIGS. 1 and 2) is dimensioned to fit on the generally planar bottom face 28 between the two lateral walls 26 and 27. Plate member 12 has a central hole 39 coaxial with the threaded hole 34 of the insert 17 to enable passage of the threaded shank 35 of the screw 18.

Referring to FIG. 2, the metallic tapered contact portion 13 is preferably made of copper and comprises a point 40 and a threaded shank 41. The point 40 is, in the illustrated example, conical. As can be seen, the point 40 and the threaded shank 41 are coaxial but disposed 180° apart from each other.

Still referring to FIG. 2 of the appended drawings, the metallic tapered contact portion 14 is preferably made of copper and comprises a point 42 and a threaded shank 43. The point 42 is, in the illustrated example, conical. As can be seen, the conical point 42 and the threaded shank 43 are coaxial but disposed 180° apart from each other.

Electrically conductive metallic contact body 15 is preferably made of copper (although other metals or conductive materials could be used), and comprises a smaller-diameter cylindrical body section 44 and a larger-diameter cylindrical body section 45. Cylindrical sections 44 and 45 are coaxial and define therebetween a circular, annular shoulder surface 46. The free end of the smaller-diameter cylindrical body section 44 is provided with a coaxial threaded hole 47 for receiving the threaded shank 41. More specifically, the threaded hole 47 is centered on the geometrical axis of the contact body 15.

In the same manner, electrically conductive metallic contact body 16 is preferably made of copper (although other metals or conductive materials could be used), and comprises a smaller-diameter cylindrical body section 48 and a larger-diameter cylindrical body section 49. Cylindrical selections 48 and 49 are coaxial and define therebetween a circular, annular shoulder surface 50. The free end 48E (See FIG. 2) of the smaller-diameter cylindrical body section 48 is provided with a coaxial threaded hole 51 for receiving the threaded shank 43. Body section 47 is similar. More specifically, the threaded hole 51 is centered on the geometrical axis of the contact body 16.

The procedure for installing the insulation-piercing connector 10 according to the present invention will now be described.

Step 1

- a central cylindrical hole 52 with a top cylindrical portion of larger diameter 53 is made through the thickness of the extrusion 22 of insulating material of the LED light strip 21 to receive the truss head machine screw 18;
- a first lateral cylindrical hole 54 (FIG. 1) is made through both the insulating material of the extrusion 22 and the ribbon conductor 23, hole 54 having a larger-diameter hole section 55 between the ribbon conductor 23 and the exposed face 56 of the extrusion 22, and a smaller-diameter hole section 57 through the ribbon conductor 23 and between this ribbon conductor 23 and the back face 58 of the extrusion 22; hole sections 55 and 57 being separated by an annular abutment surface 77 formed at least in part by one face of the ribbon conductor 23;

a second lateral cylindrical hole 59 (FIG. 1) is made through both the insulating material of the extrusion 22 and the ribbon conductor 24, hole 69 having a larger-diameter hole section 60 between the ribbon conductor 24 and the exposed face 56 of the extrusion 22, and a smaller-diameter hole section 61 through the ribbon conductor 24 and between this ribbon conductor 24 and the back face 58 of the extrusion 22, hole sections 60 and 61 being separated by an annular abutment surface 78 formed at least in part by one face of the ribbon conductor 24;

the first and second lateral cylindrical holes 57 and 61 are located on opposite sides of the central hole 52, and holes 52, 57 and 61 are lying in a common transversal plane perpendicular to the longitudinal axis of the extrusion 22; and holes 52, 57 and 61 can be made successively one after the other using specially designed tools or simultaneously using a single special tool.

Step 2 the electrically conductive metallic contact body 15 is inserted in hole 54 with the smaller-diameter body section 44 disposed in the smaller-diameter hole section 57, with the larger-diameter body section 45 disposed in the larger-diameter hole section 55, and with the annular shoulder surface 46 applied to the annular abutment surface 77 to make contact with the ribbon conductor 23; and the electrically conductive metallic contact body 16 is inserted in hole 59 with the smaller-diameter body section 48 disposed in the smaller-diameter hole section 61, with the larger-diameter body section 49 disposed in the larger-diameter hole section 60, and with the annular shoulder surface 50 applied to the annular abutment surface 78 to make contact with this ribbon conductor 24.

Step 3 the threaded shank 41 of tapered contact portion 13 is screwed into the threaded hole 47 of the smaller-diameter body section 44 to assemble the tapered contact portion 13 and electrically conductive metallic contact body 15 together, the threaded shank 43 of tapered contact portion 14 is screwed into the threaded hole 51 of the smaller-diameter body section 48 to assemble the tapered contact portion 14 and electrically conductive metallic contact body 16 together;

tightening of the threaded shank 41 in the threaded hole 47 will produce an impervious joint between the back of the point 40 and the back surface 58 of the extrusion 22; and tightening of the threaded shank 43 in the threaded hole 51 will produce an impervious joint between the back of the point 42 and the back surface 58 of the extrusion 22.

Step 4 a section of cable 19 is positioned in the groove 29 and a section of cable 20 is positioned in the groove 30;

Step 5 the silicone rubber plate member 12 is then placed on the generally planar bottom face 28 (FIG. 2) of the housing channel 11 with hole 39 aligned with the threaded hole 34 of the insert 17.

Step 6 the LED light strip 21 is clipped between the wedge-like protuberances 37 and 38 of the lateral walls 26 and 27. During this operation, the point 40 pierces both the silicone rubber plate member 12 and the insulation 62 of the insulated stranded cable 19 to make contact with the stranded conductor 63. In the same manner, the point 42 pierces both the silicone rubber plate member 12 and the insulation 64 of the insulated stranded cable 20 to make contact with the stranded conductor 65.

Step 7 the threaded shank 35 of the truss head machine screw 18 is passed through hole 52 of the extrusion 22 and hole 39 of the silicone rubber plate member 12, and is then screwed in the threaded hole 34 of the insert 17 and tightened to complete the installation of the LED light strip insulation-piercing connector 10. The screw 18 and insert 17 will of course fixedly secure the different components of the LED light strip insulation-piercing connector 10 together. Tightening of the screw 18 will also compress the silicone rubber plate member 12 between the back face 58 of the extrusion 22 and the outer surface of the insulation 62 and 64 of the cables 19 and 20 to thereby form impervious joints between (a) the point 40 and the back face 58, (b) the point 40 and the outer surface of the insulation 62, (c) the point 42 and the back face 58, and (d) the point 42 and the outer surface of the insulation 64; and a sealing washer 67 is interposed between the head 66 of the screw 18 and the annular surface 68 of the larger diameter top cylindrical hole section 58 to form an impervious joint between screw head 66 and annular surface 68.

Step 8 finally, a sealing compound, for example of the silicone type, is used to seal the larger diameter hole sections 55 and 60.

The tapered contact portion 13 and the electrically conductive metallic contact body 15 then forms an insulation-piercing contact for interconnecting the stranded conductor 63 and the copper ribbon 23. In the same manner, the tapered contact portion 14 and the electrically conductive metallic contact body 16 forms an insulation-piercing contact for interconnecting the stranded conductor 65 and the metallic ribbon 24.

Also, the housing channel 11, the silicone rubber plate member 12, the metallic nut insert 17, and the truss head machine screw 18 form a housing device which:

holds the point 40 in contact with the stranded conductor 63 to establish an electrical connection between the stranded conductor 63 and the ribbon conductor 23 through the insulation-piercing contact formed by the tapered contact portion 13 and the contact body 15;

holds the point 42 in contact with the stranded conductor 65 to establish an electrical connection between the stranded conductor 65 and the ribbon conductor 24 through the insulation-piercing contact formed by the tapered contact portion 14 and the contact body 16; and compresses the silicone rubber plate member 12 between the back face 58 of the extrusion 22 and the outer surface of the insulation 62 and 64 of the cables 19 and 20 to form impervious joints between (a) the point 40 and the back face 58, (b) the point 40 and the outer surface of the insulation 62, (c) the point 42 and the back face 58, and (d) the point 42 and the outer surface of the insulation 64.

Although the present invention has been described hereinabove by way of a preferred embodiment thereof, this embodiment can be modified at will, within the scope of the appended claims, without departing from the spirit and nature of the subject invention.

What is claimed is:

1. An insulation-piercing contact for connecting an insulated conductor with a ribbon conductor embedded in an electrically insulating body, and for insertion in a hole made through both the electrically insulating body and ribbon conductor and having a larger-diameter hole section and a smaller-diameter hole section separated by an annular abutment surface formed at least in part by one face of the ribbon conductor, said insulation-piercing contact comprising:

a contact body comprising a larger-diameter body section for insertion in the larger-diameter hole section, a smaller-diameter body section for insertion in said smaller-diameter hole section, and an annular shoulder surface for application to said annular abutment surface to make contact with said ribbon conductor, said smaller-diameter body section having a free end;

a tapered contact portion for piercing the insulation of the insulated conductor to make contact with said conductor; and means for securing the tapered contact portion to the free end of the smaller-diameter body section.

2. An insulation-piercing contact as recited in claim 1, wherein:

the larger-diameter body section and the smaller-diameter body section are both cylindrical and are arranged coaxially along a geometrical axis; and the annular shoulder surface is a planar surface perpendicular to the geometrical axis.

3. An insulation-piercing contact as recited in claim 1, wherein the contact body comprises a geometrical axis;

the tapered contact portion comprises a point for piercing the insulation of the insulated conductor to make contact with said conductor; and the securing means comprises:

a threaded hole made in the free end of the smaller-diameter body section, said threaded hole being centered on the geometrical axis of the contact body; and a threaded shank of the tapered contact portion, said threaded shank being disposed 180° apart from said point and being,screwed in the threaded hole for securing the tapered contact portion to the free end of the smaller-diameter body section.

4. An insulation-piercing connector for connecting an insulated conductor with a ribbon conductor embedded in an electrically insulating body, comprising:

an insulation-piercing contact for insertion in a hole made through both the electrically insulating body and ribbon conductor and having a larger-diameter hole section and a smaller-diameter hole section separated by an annular abutment surface formed at least in part by one face of the ribbon conductor, said insulation-piercing contact comprising:

a contact body comprising a larger-diameter body section for insertion in the larger-diameter hole section and a smaller-diameter body section for insertion in said smaller-diameter hole section, and an annular shoulder surface for application to said annular abutment surface to make contact with said ribbon conductor, said smaller-diameter body section having a free end;

a tapered contact portion for piercing the insulation of the insulated conductor to make contact with said conductor; and means for securing the tapered contact portion to the free end of the smaller-diameter body section; and a housing device for holding the tapered contact portion in contact with the insulated conductor to thereby establish an electrical connection between the insulated conductor and the ribbon conductor through the insulation-piercing contact.

5. An insulation-piercing connector as recited in claim 4, wherein the contact body comprises a geometrical axis;

the tapered contact portion comprises a point for piercing the insulation of the insulated conductor to make contact with said conductor; and the securing means comprises:

a threaded hole made in the free end of the smaller-diameter body section, said threaded hole being centered on the geometrical axis of the contact body; and a threaded shank of the tapered contact portion, said threaded shank being disposed 180° apart from said point and being screwed in the threaded hole for securing the tapered contact portion to the free end of the smaller-diameter body section.

6. An insulation-piercing connector for interconnecting (a) first and second insulated cables and (b) a LED light strip comprising:

an elongated body of at least partially transparent insulating material;

a series of light emitting diodes distributed along the elongated body;

first and second spaced apart longitudinal ribbon conductors embedded in said at least partially transparent insulating material for electrically supplying the light emitting diodes;

first and second holes made through both the elongated body and the first and second ribbon conductors, respectively, and having first and second larger-diameter hole sections and first and second smaller-diameter hole sections separated by first and second annular abutment surfaces formed at least in part by one face of the first and second ribbon conductors, respectively; and said insulation-piercing connector comprising:

first and second insulation-piercing contacts respectively including:

first and second contact bodies comprising first and second larger-diameter body sections for insertion in the first and second larger-diameter hole sections, respectively, and first and second smaller-diameter body sections for insertion in said first and second smaller-diameter hole sections, respectively, and first and second annular shoulder surfaces for application to said first and second annular abutment surfaces to make contact with said first and second ribbon conductors, respectively, said first and second smaller-diameter body sections having respective first and second free ends;

first and second tapered contact portions for piercing the insulation of the first and second insulated cables, respectively, and making contact with said first and second cables; and first and second means for securing the first and second tapered contact portions to the first and second free ends of the first and second smaller-diameter body sections, respectively; and a housing device (a) for holding the first tapered contact portion in contact with the first cable to thereby establish a first electrical connection between the first cable and the first ribbon conductor through the first insulation-piercing contact, and (b) for holding the second tapered contact portion in contact with the second cable to thereby establish a second electrical connection between the second cable and the second ribbon conductor through the second insulation-piercing contact.

7. An insulation-piercing connector as recited in claim 6, wherein:

the first and second contact bodies comprise respective first and second geometrical axes, the first and second tapered contact portions comprise first and second points for piercing the insulation of the first and second insulated cables, respectively, and making contact with said first and second cables, and the first and second securing means respectively comprise:

first and second threaded holes made in the first and second free ends of the first and second smaller-diameter body sections, respectively, said first and second threaded holes being respectively centered on the first and second geometrical axes; and first and second threaded shanks of the first and second tapered contact portions, respectively, said first and second threaded shanks being disposed 180° apart from the first and second points and being screwed in the first and second threaded holes, respectively, for securing the first and second tapered contact portions to the first and second free ends of the first and second smaller-diameter body sections, respectively.

8. An insulation-piercing connector as recited in claim 6, wherein the housing device comprises:

a housing channel defining a channel cavity with a generally planar bottom face;

first and second longitudinal grooves in the generally planar bottom face to receive sections of the first and second insulated cables, respectively.

9. An insulation-piercing connector as recited in claim 8, wherein the housing device further comprises a resilient plate member applied to the generally planar bottom face after sections of the first and second insulated cables have been inserted in the first and second longitudinal grooves, respectively.

10. An insulation-piercing connector as recited in claim 9, wherein the housing channel comprises first and second lateral walls having first and second mutually facing inner faces, the first and second mutually facing inner faces being formed with respective longitudinal and distal thickenings to clip the LED light strip on the resilient plate member after the first and second tapered contact portions have pierced the resilient plate member and the insulation of the first and second insulated cables, respectively, to make contact with said first and second cables, respectively.

11. An insulation-piercing connector as recited in claim 9, wherein the housing channel comprises a bottom wall, and wherein the housing device further comprises:

an insert-receiving aperture in the bottom wall of the housing channel;

an insert having a threaded hole, said insert fitting in the aperture with the threaded hole perpendicular to the bottom wall of the housing channel; and a screw inserted in a first hole made in the elongated body of the LED light strip and a second hole made in the resilient plate member, said first and second holes being coaxial with the threaded hole of the insert to enable the screw to pass through the first and second holes before being screwed in the threaded hole of the insert.

12. An insulation-piercing connector as recited in claim 6, further comprising means for sealing the first and second larger-diameter hole sections after the first and second contact bodies have been inserted in the first and second holes, respectively, and the first and second tapered contact portions have been secured to the first and second free ends, respectively.

* * * * *